US006751437B2

(12) United States Patent
Shimazu

(10) Patent No.: US 6,751,437 B2
(45) Date of Patent: Jun. 15, 2004

(54) IMAGE FORMING APPARATUS

(75) Inventor: Akihiko Shimazu, Tokyo (JP)

(73) Assignee: Konica Corporatioin, Tokyo (JP)

( * ) Notice: Subject to any disclaimer, the term of this patent is extended or adjusted under 35 U.S.C. 154(b) by 0 days.

(21) Appl. No.: 10/351,939

(22) Filed: Jan. 27, 2003

(65) Prior Publication Data

US 2003/0143004 A1 Jul. 31, 2003

(30) Foreign Application Priority Data

Jan. 29, 2002 (JP) ..... 2002-019892

(51) Int. Cl.[7] ..... G03G 15/00
(52) U.S. Cl. ..... 399/396
(58) Field of Search ..... 399/68, 364, 381, 399/388, 394, 396; 271/9.01, 9.11, 9.13

(56) References Cited

U.S. PATENT DOCUMENTS 6,526,254 B2 * 2/2003 Futagawa ..... 399/68
6,529,703 B2 * 3/2003 Kawasumi et al. ..... 399/388

FOREIGN PATENT DOCUMENTS

JP 09-231133 9/1996

* cited by examiner

*Primary Examiner*—Hoang Ngo
(74) *Attorney, Agent, or Firm*—Frishauf, Holtz, Goodman & Chick, P.C.

(57) ABSTRACT

An image forming apparatus is provide which includes an ADU that can sustain productivity per unit of time, without controlling the operation of registration rollers at fixed intervals determined by CPM that leads to temporary stopping of paper. During non-stacked circulatory conveyance for forming images on both sides of a sheet of paper, the position or the timing is corrected at which the paper is accelerated and/or decelerated in a circulatory conveyance path, whereby the image forming apparatus does not control the operation of registration rollers at fixed intervals determined by CPM when forming another image on a back side of the paper.

5 Claims, 4 Drawing Sheets

IMAGE FORMING APPARATUS

BACKGROUND OF THE INVENTION

1. Field of the Invention

The present invention relates to an image forming apparatus such as a printer or an electrophotographic copier, in which paper is conveyed in a circulatory conveyance path for formation of images on both sides of the paper.

2. Description of the Related Art

Image forming apparatuses are known which comprise circulatory conveyance means (hereinafter referred to as an ADU) for reversibly conveying paper on which an image has been formed on one side of the paper and circulatorily conveying the paper in order to allow images to be formed on both sides of the paper such as standard paper.

Among these image forming apparatuses, there is known a type of image forming apparatus employing a so-called non-stacked circulatory conveyance method in which a plurality of sheets of paper (e.g., five sheets of paper) are continuously supplied from a paper supply tray, a toner image formed on a photosensitive drum is continuously transferred onto a first or front side of the paper and the toner image is fixed onto the paper. Thereafter, the paper is reversed by the ADU, and circulatorily conveyed towards the transfer region where another toner image formed on the photosensitive drum is transferred onto a second or back side of the paper, fixed to the paper, and then the paper is discharged to a discharge tray, so that plural sheets of paper are not stacked at a time in an intermediate tray.

FIG. 1 shows, in an illustrative view, an example of the structure of such image forming apparatus.

A copier as an example of such image forming apparatus comprises an automatic document feeder 1 on an upper part of the body of the copier, and includes within the copier body an image reader 2, an image formation section 3, a paper housing section 4, a paper supply section 5, a reverse/discharge/paper resupply section 6, and an ADU 8 that serves as the circulatory conveyance means.

The automatic document feeder 1 is a device for sending out documents one by one at a time, conveying the documents to an image reading position, and discharging documents whose image has been read to a predetermined place. The automatic document feeder 1 includes a document mount 11 on which documents are mounted; document separation means 12 for separating the documents mounted on the document mount 11; document conveying means 13 including plural rollers for conveying the documents separated by the document separating means 12; document discharge means 14 for discharging the documents conveyed by the document conveying means 13; a document discharge tray 15 for receiving the documents discharged by the document discharge means 14; and document reversal means 16 comprising a pair of rollers for reversing the documents to read images on both sides of the documents. Plural sheets of the documents (not illustrated) mounted on the document mount 11 are separated one by one at a time by the document separation means 12, and conveyed toward the image reading position by the document conveying means 13.

The image reader 2 is disposed below the document conveyance means 13, and images on the documents are read through a slit 21 forming the image reader 2. Documents whose images have been read are discharged onto the document discharge tray 15 by the document discharge means 14.

When images on both sides of a document are to be read, documents for which an image on one side has been read are guided to the document reversal means 16, the documents are reversed by counter-rotational control of the rollers in a state in which trailing ends of the documents are held between the rollers, and then the documents are conveyed once more by the document conveyance means 13, whereby it is possible to read the images on the other sides of the documents at the image reading position. This process is repeated for the number of documents mounted on the document mount 11.

The automatic document feeder 1 is structured to be retractable. By retracting the automatic document feeder 1, a document can be mounted directly on a platen glass 22 and copied.

The image reader 2 is a means for obtaining image data by reading the images on the documents. The image reader 2 includes the slit 21; a first mirror unit 23 comprising a lamp 231 as a light source that irradiates the documents, and a first mirror 232 that reflects light reflected from the documents; a second mirror unit 24 comprising a second mirror 241 for reflecting light from the first mirror 232 and a third mirror 242; an image formation lens 25 that images onto an image pickup device 26 such as CCD light reflected from the second mirror unit 24; and a line CCD 26 adapted to obtain image information by photoelectrically converting the light image imaged by the image formation lens 25. After the image information thus obtained is subjected to appropriate image processing, it is temporarily stored in a memory not shown.

When the documents fed by the automatic document feeder 1 are read by the image reader 2, the first mirror unit 23 and the second mirror unit 24 are positioned as illustrated.

Images on documents that are directly mounted onto the platen glass 22 are read by the first mirror unit 23 and the second mirror unit 24 which are moved along the platen glass 22 while maintaining an optical path length therebetween.

The image formation section 3 forms images by an electrophotographic process on the basis of the image data obtained by the image reader 2. The image formation section 3 includes the photosensitive drum 31 having on a surface thereof a photoelectrically conductive photosensitive layer; an electrifier 32 for uniformly electrifying the surface of the photosensitive drum 31; a laser writing system 33 as an exposure means for exposing the photosensitive drum 31 to form a latent image thereon that is activated on the basis of the image-processed image data; a developer 34 for developing the latent image formed on the photosensitive drum 31 to form a toner image; a transfer electrode 35 for transferring the toner image onto the paper; a charge remover 36 for accelerating separation of the paper with the toner image transferred thereon from the photosensitive drum 31 by effecting an AC corona discharge to remove the charge; cleaning means 37 for cleaning the photosensitive drum 31 after the transferring process has been concluded; a fixing device 38 of heating roller type for fixing the toner image on the paper; and the reverse/discharge/paper resupply section 6 and the ADU 8.

The photosensitive drum 31, which is rotated in a direction shown by an arrow by appropriate drive means, is sequentially electrified by the electrifier 32, the electrostatic latent image is formed by dot exposure by the laser writing system 33, and the toner image is formed by the developer 34. Then, the toner image is transferred via the action of the transfer electrode 35 onto the paper that is synchronously conveyed by initiating rotation of registration rollers 56, which are second paper supply means, so that the paper is superposed on the toner image region, whereby an image is formed on the paper.

The paper with the toner image transferred thereon is separated from the photosensitive drum 31 by the charge remover 36, and the toner image is fixed on the paper by the heat and pressure applied by the fixing device 38.

The photosensitive drum 31 continues to rotate while the remaining toner on the photosensitive drum 31 which has passed through the transfer region is removed by the cleaning means 37 for preparation of the next image formation.

A conveyor belt 39 for conveying the paper separated from the photosensitive drum 31 by the charge remover 36 is disposed between the charge remover 36 and the fixing device 38.

Paper feed trays 400, 410 and 420 including housing sections 405, 415 and 425 comprising housing containers for housing stacked sheets of the paper and the paper supply units 51, 52 and 53 that serve as first paper supply means are arranged one on another in the paper housing section 4. Sheets of paper of different size are respectively housed in these paper feed trays 400, 410 and 420.

The paper supply units 51, 52 and 53 include paper separation rollers 506, 536 and 556 for preventing overlapping supply of paper and paper supply rollers 505, 535 and 555 which are positioned at substantially fixed positions with respect to the paper feed trays loaded in position in predetermined positions in the apparatus.

The paper supply section 5 includes pairs of conveying roller R1, R2, R3, R4, R5 and R6 as conveying means for conveying the paper from the respective paper feed trays to the image formation section 3. PS is a photosensor which detects whether or not paper that has been fed from the paper feed trays has arrived at the positions of the conveying roller R1, R2 and R3 disposed downstream of the separation rollers.

The reverse/discharge/paper resupply section 6 is a region for discharging the imaged paper or resupplying the imaged paper in accordance with a required copying process. The reverse/discharge/paper resupply section 6 includes switching means 62 for switching the conveying path depending upon the situation that (1) the paper discharged by the fixing/discharge rollers 61 is to be discharged as it is to the outside of the apparatus, (2) the paper is to be discharged after it has been reversed, or (3) the paper is resupplied in order to form an image on the back side of the paper.

If it is required that the imaged paper is to be discharged with the final image formed on its top side, the switching means 62 is positioned as indicated by one-dotted chain line in the drawing. On the other hand, if it is required that the imaged paper is to be reversed to form images on both sides of the paper and then discharged, the switching means 62 is positioned as indicated by a solid line in the drawing, the paper conveyed by the fixing/discharge rollers 61 is once conveyed toward the ADU 8. Having passed through the switching means 62, the paper is reversibly conveyed by the conveying rollers 600 so that it passes through the left side of the switching means 62, and is discharged by the discharge rollers 63 onto the discharge tray 64 outside of the apparatus.

Moreover, if it is required that an image is to be formed on the back side of the paper as well, the switching means 62 is positioned as indicated by the solid line in the drawing, the paper conveyed by the fixing/discharge rollers 61 is conveyed as far as the ADU reversal rollers 800 by each of the conveying rollers of the reverse/discharge/paper resupply section 6 driven by a discharge motor, the paper is reversed by switching back by means of these rollers, and the paper is circulatorily conveyed to the registration rollers 56.

In the above structure, the ADU reversal rollers 800 are driven forwards and backwards by an ADU reversal motor M2 shown in FIG. 2, the conveying rollers 810, 820, 830, 840 and 850 are driven by a conveying motor M2 (as shown in FIG. 2) as a driving source, and the registration rollers 56 are driven by a registration motor M5 shown in FIG. 2.

The following operations will occur in a case where, for example, five sheets of paper are taken as a set and continuous image formation is effected by using the non-stacked circulatory conveyance method.

To describe the process by which image are formed on both sides using the ADU 8 while noting the motion of the paper, the five sheets of the paper, which are continuously fed at every predetermined time from the paper feed tray 40 in response to the implementation of the image formation process, reach the registration rollers 56 via the conveying rollers 55, are detected by a detection means not shown, resupplied by the rotation of the registration rollers 56, and enter the transfer region so that each paper is superposed on the toner image region formed on the photosensitive drum 31.

The toner image is transferred onto the first side of the paper by the action of the transfer electrode 35 in the transfer region and the paper is separated from the photosensitive drum 31 and conveyed toward the fixing device 38.

The paper with the toner image fixed thereon by the action of heat and pressure in the fixing device 38, is conveyed downward along the conveyance path that has been switched by the fixing/discharge rollers 61 and the switching means 62, is sequentially moved along the conveyance path formed toward the upper right direction by the conveyance rollers 600, 610 and 620, and thereafter reaches the ADU reversal rollers 800.

The ADU reversal rollers 800 are driven to rotate in the opposite direction at a timing at which the rear edge of the paper is nipped between the ADU reversal rollers 800 in the traveling direction. Therefore, the paper is reversed and conveyed on the conveyance path formed by the ADU 8, i.e., horizontally towards the right of the drawing at the conveying rollers 810 through 850, while the paper is conveyed in the opposite direction with its previous rear edge being as a new front edge. Thereafter, the paper is guided upward and sequentially arrive at the registration rollers 56 after passing through the conveying rollers 55, and a toner image is formed on the second side of the paper in the same process that has been described previously.

After the toner image on the second side of the paper is fixed by the fixing device 38, the paper is sequentially discharged onto the discharge tray 64 via the fixing/discharge rollers 61.

In this kind of image forming apparatus, a predetermined paper size (in particular, a length of paper in its travelling direction) is used as a standard, and a number of sheets of paper with an image formed thereon obtainable per unit of time is set for various paper size (feeding length). In order to achieve this, a distance from the exposure section to the transfer electrode 35 and a distance from the registration rollers 56 to the transfer electrode 35 are set to be equal to each other so that the paper of standard size reaches the registration rollers 56, the process for forming a toner image on the photosensitive drum 31 is initiated at a timing of supply of the paper by the registration rollers 56 and the paper is superposed on the toner image region at a transfer region of the transfer electrode 35. The registration rollers 56 are always activated at fixed intervals by setting linear velocities of the photosensitive drum 31, the registration rollers 56 and the transfer rollers 57 to be the same. Various operative conditions such as a length of the circulatory conveyance path of the paper are set so that a distance between consecutive papers with images formed on their first sides can be the same as a distance between the last paper that will just have an image formed on its first side and the first paper that will have another image formed on its second side by controlling the registration rollers 56 to be activated at a predetermined interval of time. With this structure, high productivity per unit of time that is a number of papers with images formed on both sides thereof that can be obtained per unit of time (minute) (hereinafter referred to as CPM) is realized.

In the image forming apparatus with the above described, any advance or delay for paper to arrive at the registration rollers 56 may occur after an image has been transferred on the paper on its first side and fixed until the paper is reversed for formation of another image on its second side thereof. One of causes for such unstable movement of the paper is that the paper is conveyed only by the conveyor belt 39 after the paper is separated from the photosensitive drum 31 until it is nipped by the pair of rollers of the fixing device 38. Therefore the paper may be moved out of place forward and backward on the conveyor belt 39 during conveyance. Another cause is that the ADU reversal rollers 800 may slip when the paper is reversed thereby in the circulatory conveyance path.

There has been proposed a method to solve this problem in which the paper is conveyed to the position of the registration rollers 56 at an earlier time and is caused to wait there until the scheduled time to adjust the advance or delay of the paper.

Another method for compensating the advance or delay of the paper is disclosed in Japanese unexamined patent publication No. 8-231133 in which conveying rollers are stopped temporarily to cease the paper depending upon the condition of the paper while being conveyed in the circulatory conveyance path so that the advance or delay of the paper is adjusted before it arrives at the registration rollers. However, some of the conveying rollers must be stopped while others need not be stopped depending upon the size of the paper, so that a conveying mechanism including the rollers and control are complicated. This will result in high cost of the apparatus and causes a difficulty in down sizing of the apparatus.

In some kinds of apparatus, conveying velocity of the paper is controlled to be accelerated and then decelerated during conveyance in order to realize high CPM (For example, Japanese unexamined patent publication No. 58-182655).

SUMMARY OF THE INVENTION

The present invention was made in the light of the above-described circumstances, and it is an object of the present invention to provide an image forming apparatus of high CPM in which paper is circulatorily conveyed without being temporarily stopped.

In order to achieve this object, according to the first aspect of the present invention, there is provided an image forming apparatus comprising first paper supply means for supplying paper one sheet at a time; second paper supply means for receiving the paper from the first paper supply means and conveying the paper to an image formation section; the image formation section for forming an image by fixing a toner image after the toner image has been transferred to the paper supplied from the second paper supply means; and circulatory conveyance means for reversibly conveying and circulatorily conveying the paper, on which the image has been formed on a first surface thereof, to the second paper supply means once again, in order to form an image on a second surface of the paper, on which the image has been formed on the first surface thereof by the image formation section; after an image has been sequentially formed on the first surfaces of a predetermined number of sheets of the paper by the image formation section, the sheets of paper being reversibly conveyed and circulatorily conveyed to the second paper supply means by the circulatory conveyance means, and then image being successively formed on the second surfaces of the paper, on which the image has been formed on the first surfaces thereof; wherein a position at which the paper, on which the image has been formed on the first surface thereof, is accelerated from the paper conveyance speed during image formation in order for reversal and a position at which the post-reversal paper conveyance speed is decelerated in order to form the image on the second surface of the paper are alterable; and wherein images are formed on both sides of the paper without effecting control of the operation of the second paper supply means restricted by the number of image formed sheets per unit of time.

In the above aspect, the position or the timing at which the paper is accelerated for reversal may be determined by measuring the actual time from when conveyance of the paper from the second supply means to the image formation section is initiated to when the paper arrives at a position at which acceleration is possible.

Furthermore, the position or the timing at which the conveyance velocity of the reversed paper is decelerated may be determined by measuring an actual time required for the paper to arrive at a position where deceleration is possible from the position where reversal of the paper started.

According to the second aspect, there is provided an image forming apparatus having a paper waiting position where a sheet of paper to be supplied to an image formation section is caused to wait temporarily and a paper reversing means for reversing said paper with an image formed on one side thereof, said image forming apparatus comprising a paper supply means for supply paper from said paper waiting position to said image formation section; a first paper conveying means for conveying the paper with the image formed on one side thereof from said image formation section to said paper reversing means; a second paper conveying means for conveying the paper reversed by said paper reversing means to said paper waiting position; a controlling means for controlling a paper conveying velocity so that said paper is accelerated at a predetermined timing during being conveyed by said first paper conveying means and the reversed paper is decelerated at another predetermined timing during being conveyed by said second paper conveying means; and a correction means for correcting said timing of acceleration and deceleration of said paper.

The inventor of the present invention arrived at the invention by realizing that, in the image forming apparatus employing the non-stacked circulatory conveyance method for forming images on both sides of a sheet of paper, fluctuations of time required for the paper to arrive at the registration rollers for the purpose of formation of an image on the back side of the paper can be compensated by correcting the position or the timing at which the reversed paper is accelerated and/or decelerated in the circulatory conveyance path. As a result, it is not necessary to control the operation of the registration rollers at fixed intervals determined by CPM when forming an image on the back side of the paper.

DESCRIPTION OF THE PREFERRED EMBODIMENT

The invention will now be described below on the basis of the drawings. However, the invention is not limited to the embodiment shown therein.

Figure 1:
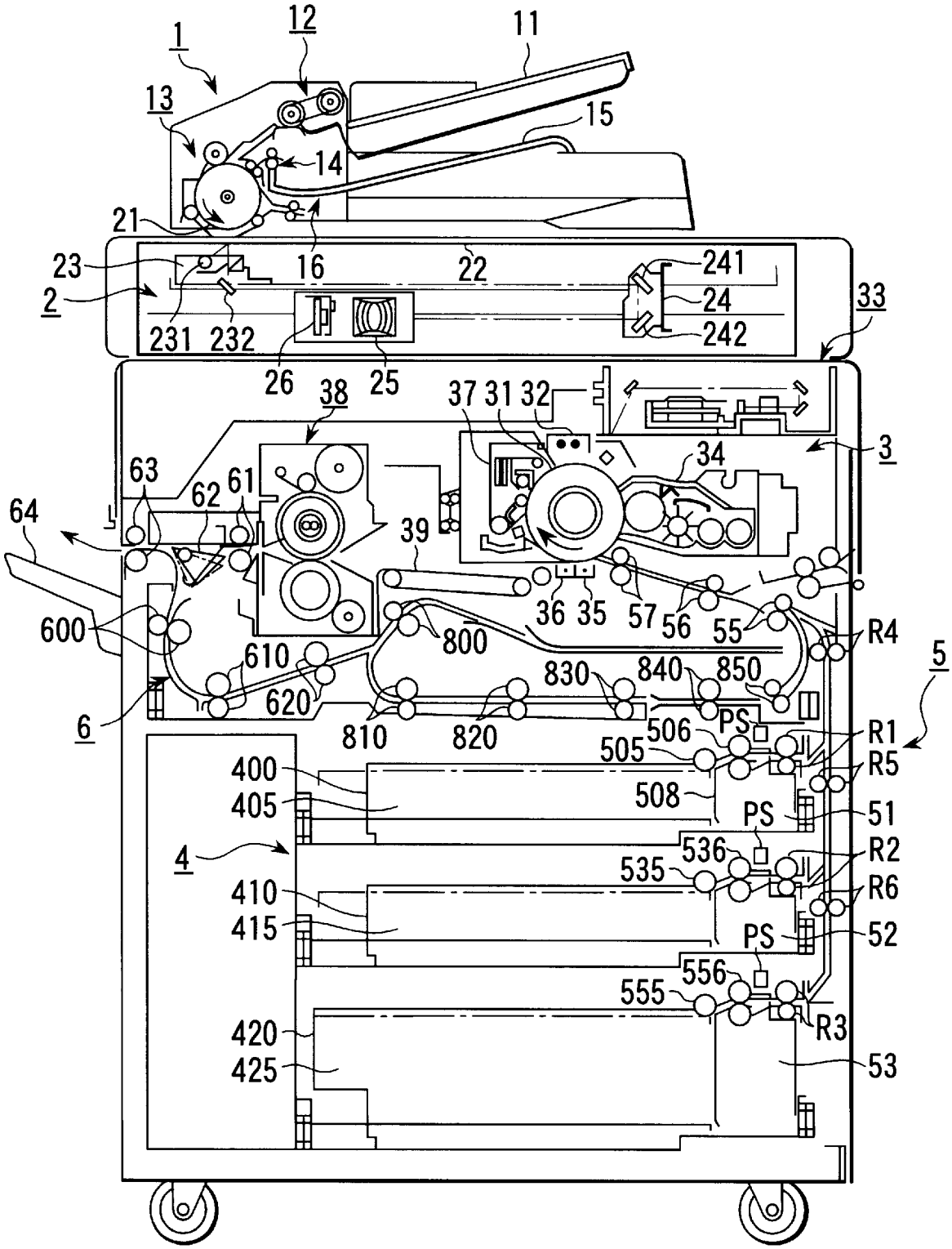
FIG. 1 is an illustrative view showing an example of the structure of a non-stacked circulatory conveyance image forming apparatus.

The detailed structure of the image forming apparatus according to the invention has been described with reference to FIG. 1 and therefore description thereof will be omitted here. However, since the invention relates to controlling of the conveyance of paper, the circulatory conveyance path of the paper will be described with reference to FIG. 2.

Figure 2:
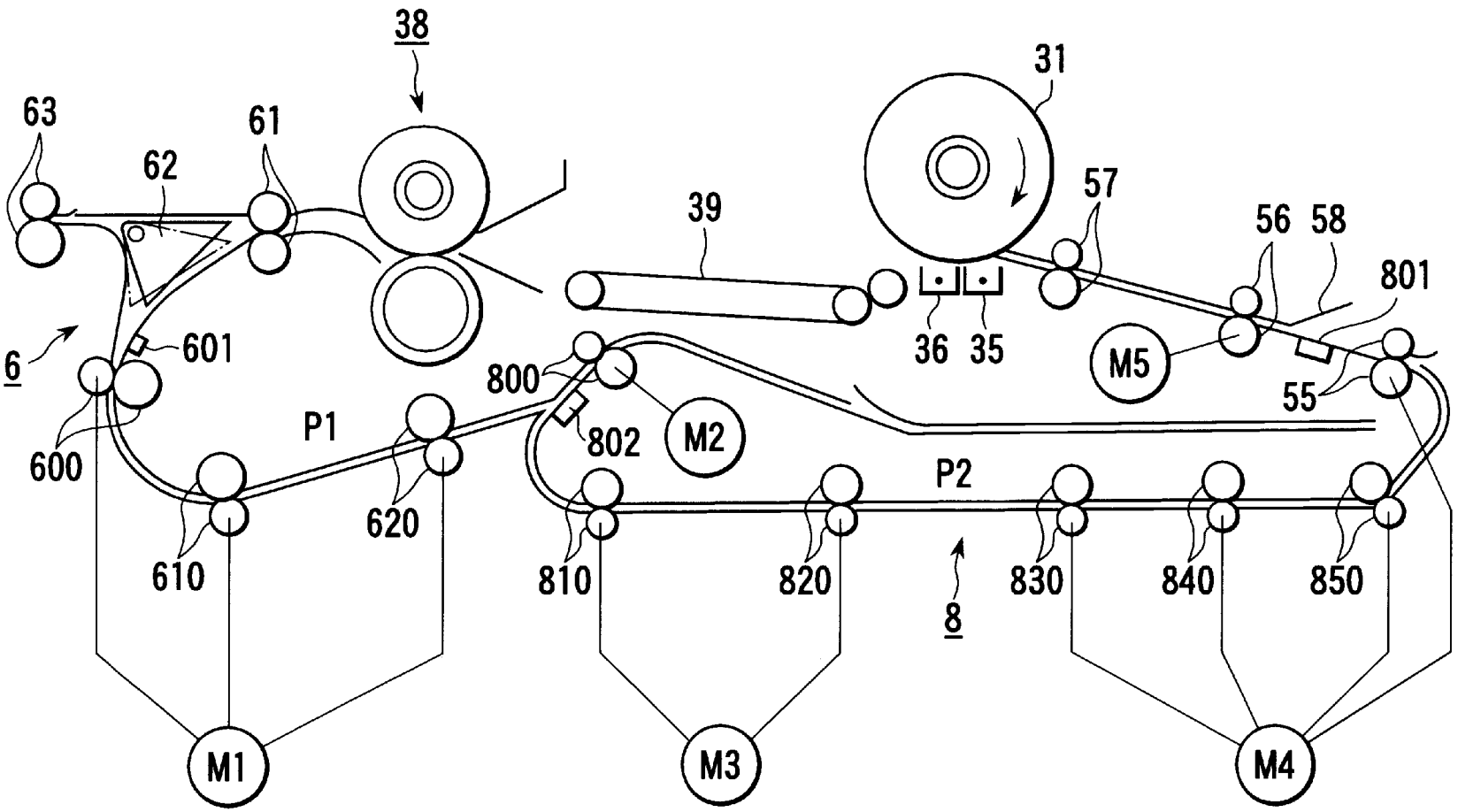
FIG. 2 is a model view showing a circulatory conveyance path of the image forming according to the present invention.

FIG. 2 is a model view showing the circulatory conveyance path of the image forming apparatus pertaining to the invention. A series of conveying rollers which take part in conveyance of the paper are sectioned in some groups to variably control conveyance velocity of the paper. The conveying rollers in different sections are driven by different motors. As shown exemplarily in FIG. 2, conveying rollers 600, 610 and 620 are driven by a motor M1, the ADU reversal motor 800 is driven to rotate reversibly by a motor M2, conveying rollers 810 and 820 are driven by a motor M3 and conveying rollers 830, 840, 850 and 55 are driven by a motor M4. The registration rollers 56 are driven by a motor M5.

On the other hand, along the circulatory conveyance path of the paper, an acceleration sensor 601 is arranged upstream of the conveying rollers 600 to detect the timing at which the rear edge of the paper with an image formed on its first side has slipped out of the nip by the pair of rollers of the fixing device 38, a reversal sensor 802 is arranged in the vicinity of the ADU reversal rollers 800 to detect the rear edge of the paper conveyed rightwards thereby and a deceleration sensor 801 is arranged upstream of the registration rollers 56 to detect the front edge of the paper which has been reversed by the ADU reversal rollers 800 and is about to arrive the registration rollers 56.

Figure 3:
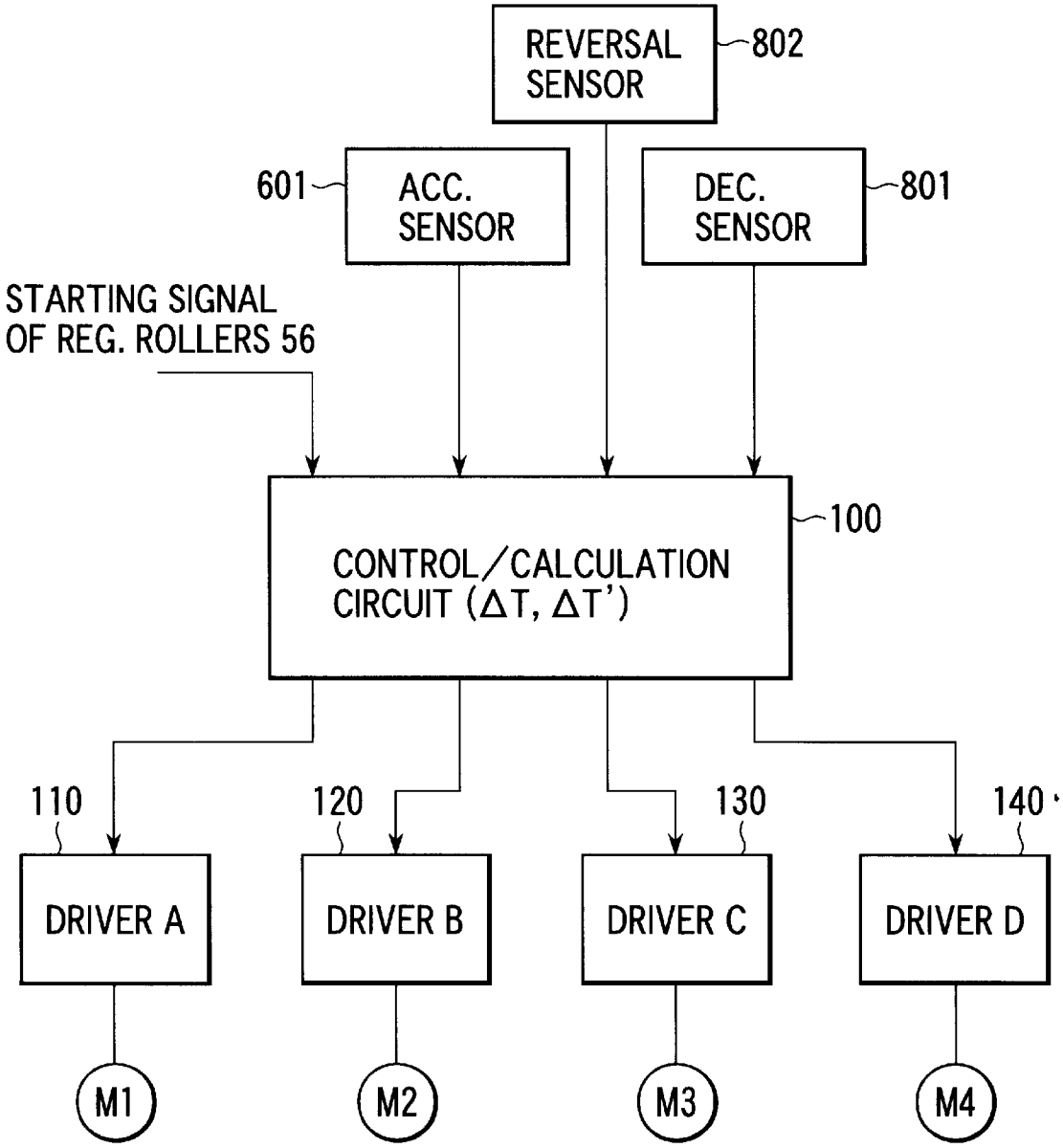
FIG. 3 is a block diagram of a conveyance correction circuit of the image forming apparatus according to the present invention.

FIG. 3 shows a block diagram of the conveyance correction circuit of the image forming apparatus according to the present invention.

As shown in FIG. 3, the conveyance correction circuit comprises a control/calculation circuit 100 for measuring an actual time required for paper to travel along the paper conveyance path on the basis of the outputs of the acceleration sensor 601, the deceleration sensor 801 and the reversal sensor 802 and a starting signal of the registration rollers 56 and for calculating necessary correction time s ΔT and ΔT'; and drivers 110, 120, 130 and 140 for driving motors M1, M2, M3 and M4, respectively.

Explanation will now be given to conveyance of the paper and its correction with reference to FIGS. 2, 3 and 4.

In the image formation process, a toner image is transferred onto the front or first side of the paper by the action of the transfer electrode 35. The paper carrying the toner image is separated from the photosensitive drum 31, conveyed towards the fixing device 38 by the conveyor belt 39 and the toner image is fixed by the action of heating and pressure applied to the paper in the fixing device 38. In the process, the paper conveyance velocity is synchronous with rotation velocity of the photosensitive drum 31 and will be referred to as process linear velocity below.

The fixed paper is conveyed downwards by the rollers 61 through the path defined by switching of the Switching means 62 and then further conveyed by the conveying rollers 600, 610 and 620 driven by the motor M1. When the acceleration sensor 601 detects the timing at which the rear edge of the paper has slipped out of the nip of the pair of the fixing device 38, the control/calculation circuit 100 outputs an acceleration signal to the driver A 110 and the driver B 120 a predetermined time "a" later than the detection by the acceleration sensor 601, so that the motors M1 and M2 are accelerated up to a predetermined velocity which is higher than the process linear velocity which is referred to as reverse approach linear velocity.

As a result, the conveying rollers 600, 610, 620 and the ADU reversal rollers 800 are caused to rotate at the reverse approach linear velocity. The time "a" is predetermined in terms of a length of the circulatory conveyance path and related velocities i.e. the process linear velocity, the reverse approach linear velocity and a reverse discharge linear velocity which will be mentioned later), so that an interval between consecutive sheets of paper to be image formed on the first side thereof is equal to an interval between the last one of those sheets of paper and the first one of those sheets of paper to be image formed on the second side thereof.

The control/calculation circuit 100 measures an actual time (t) between the instant at which the registration rollers 56 starts and the instant at which the paper has just slipped out of the nip of the pair of rollers of the fixing device 38 on the basis of the starting signal of the registration rollers 56 and the output of the acceleration sensor 601 and compares the actual time (t) as measured with a theoretical conveyance time (t0). Then the control/calculation circuit 100 calculates a correction time ΔT which is used to correct the timing at which the process linear velocity is switched to the reverse approach linear velocity for correction of advance or delay of conveyance of the paper.

Specifically, taking Vp as the process linear velocity and Vr as the reverse approach linear velocity the correction time ΔT is calculated in the following manner:

$$\Delta T=(t0-t)\times Vr/(Vr-Vp)$$

Assuming by way of example that the process linear velocity Vp is 420 mm/s and time difference (t0−t) is 10 ms when the reverse approach linear velocity Vr is 913 mm/s, ΔT (msec)=−0.01×913/(913−420)=−0.0185 (msec). This means that acceleration timing or position is shifted upstream of the paper conveyance path by 18.5 msec. Namely the acceleration of the paper is triggered 18.5 msec earlier than predetermined.

When the rear edge of the paper which has been conveyed by the rollers 600, 610, 620 and the ADU reversal rollers 800 in a conveyance path P1 at the reverse approach linear velocity is detected by the reverse sensor 802, the motor M2 is reversed so that the ADU rollers 800 are reversed. As a result, the paper is conveyed by the conveying rollers 810, 820, 830, 840 and 850 in a conveyance path P2.

The control/calculation circuit 100 measures an actual time (t') between the instant at which the rear edge of the paper is detected by the reversal sensor 802 and the instant at which the front edge of the paper is detected by the deceleration sensor 801 on the basis of outputs of the reversal sensor 802 and the deceleration sensor 801 and compares the actual time (t') as measured with a theoretical conveyance time (t0'). Then the control/calculation circuit 100 calculates a correction time ΔT' which is used to correct the timing at which the reverse discharge linear velocity is switched to the process linear velocity for correction of advance or delay of conveyance of the paper.

Usually the reverse discharge linear velocity is switched to the process linear velocity a predetermined time "b" later than the timing at which the front edge of the paper is detected by the deceleration sensor 801. At this timing the control/calculation circuit 100 outputs an deceleration signal to the driver C 130 and/or the driver D 140 so that the motor M3 and/or the motor M4 are decelerated. Depending upon the size of the paper (length of the paper in the traveling direction), either or both of the motors M3 and M4 may be decelerated. The time "b" is determined from the same standpoint for determination of the time "a" as above explained.

Specifically, taking Vro as the reverse discharge linear velocity, the correction time ΔT' is calculated in the following manner:

$$\Delta T'=(t0'-t')\times Vp/(Vp-Vro)$$

Assuming that the reverse discharge linear velocity Vro is 970 mm/s and a time difference (t0'−t') is 10 ms when the process linear velocity Vp is to be returned to 420

$$\text{mm/s},\ \Delta T'\ (\text{msec}) = -0.01\times 420/(420-970) = -0.0076\ (\text{msec}).$$

This means that deceleration timing or position is shifted downstream of the paper conveyance path by 7.6 msec. Namely the deceleration of the paper is triggered 7.6 msec later than predetermined.

Velocity correction is effected by advancing or delaying a timing at which the control/calculation circuit 100 outputs a deceleration signal to the driver C 130 and/or the driver D 140, by the correction time ΔT' later than the predetermined time "b". In the above example, the deceleration signal is outputted 7.6 msec later than the predetermined time "b". Thus the motors M3 and/or M4 are decelerated ΔT' later than the predetermined time "b".

After deceleration of the motors M3 and/or M4,the paper is conveyed upwards in the drawing through the conveyance rollers 55 again at the process linear velocity until it reaches the registration rollers 56. When the front edge of the paper hits the registration rollers 56, a specific amount of loop is formed along a guide 58 arranged there so that deviation or shift of the paper is corrected. At this time, differently from the step in which an image is formed on the first side of the paper, other conveying rollers while nipping the paper do not stop and the timing of restart of the registration rollers 56 is not controlled in terms of the timing determined by CPM, but the registration rollers 56 are restarted a specific time later after the paper has arrived. Thereafter another image is formed on the second side of the paper via the same process.

In the present invention, because fluctuations of conveyance time is repeatedly corrected in the above-described manner for every unit of sheets of paper for which a continuous circulation is permitted depending upon paper size in the conveyance direction, an expected CPM can be sustained.

Figure 4:
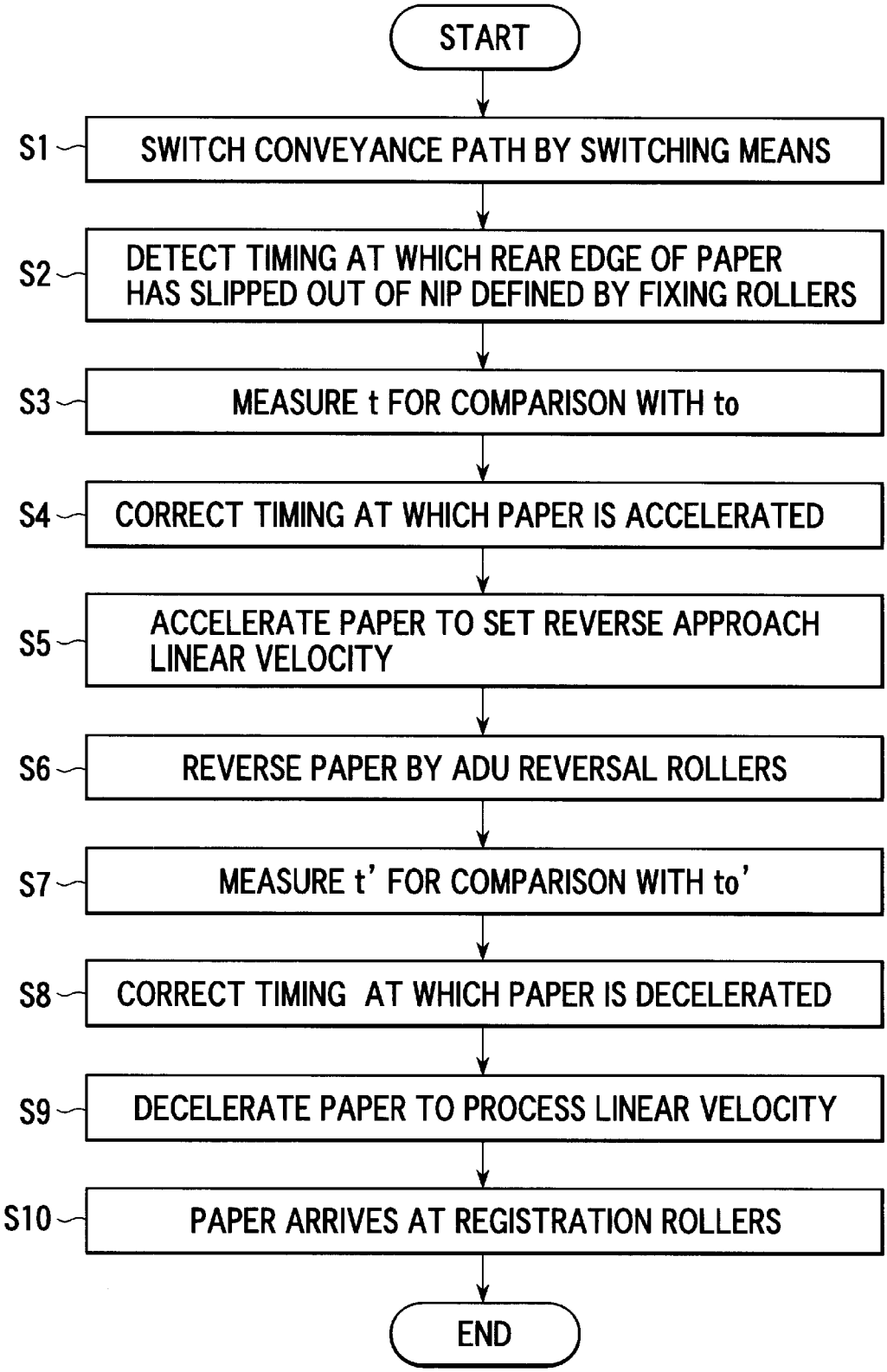
FIG. 4 is a flow chart of operations of circulatory conveyance means according to the invention.

FIG. 4 shows a flow chart of operation for correction of conveyance of the paper pertaining to the invention.

The operation starts at the point of time when an image formed on the first side of the paper is fixed and the paper arrives at the fixing/discharge rollers 61. The conveyance path is switched to the position shown by a solid line in FIG. 2 by the switching means 62 (Step S1). Then the acceleration sensor 601 detects the timing at which the rear edge of the paper has slipped out of the nip defined by the fixing rollers (Step S2). The control/calculation circuit 100 measures the actual time (t) elapsed between the instant at which the registration rollers 56 have started and the instant at which the rear edge of the paper has slipped out of the nip of the fixing device 38 and compares the actual time (t) with the theoretical conveyance time (t0) (Step S3).

The control/calculation circuit 100 calculates the correction time ΔT to correct the timing at which the paper is accelerated from conveyance at the process linear velocity (Step S4) and the paper is accelerated to the predetermined reverse approach linear velocity (Step S5).

Next, the paper is reversed by the ADU reversal rollers 800 (Step S6). The control/calculation circuit 100 measures the actual time (t') between the instant at which the reversal sensor 802 detects the rear edge of paper and the instant at which the deceleration sensor 801 detects the front edge of the paper and compares the actual time (t') with the theoretical conveyance time (t0') (Step S7). Then the control/calculation circuit 100 calculates the correction time ΔT' to correct the timing at which the paper is decelerated from conveyance at the reverse discharge linear velocity (Step S8). The paper is decelerated to the process linear velocity (Step S9) and arrives at the registration rollers 56 passing through the conveyance rollers 55 (Step S10). The process of image formation onto the second side of the paper is initiated, and a series of operations concludes.

According to the present invention, in the image forming apparatus employing the non-stacked circulatory conveyance method for forming images on both sides of a sheet of paper, fluctuations in time required for the paper to arrive at the registration rollers for the purpose of formation of the image on the back side of the paper is compensated by correcting the position or the timing at which the paper is accelerated and/or decelerated in the circulatory conveyance path and therefore it is not necessary to control the operation of the registration rollers at fixed intervals determined by CPM when forming the image on the back side of the paper, and there is also no need to structure the device so that conveying rollers other than the registration rollers are stopped in the circulatory conveyance path, whereby control and drive structure can be simplified.

What is claimed is:

1. An image forming apparatus comprising:

first paper supply means for supplying paper one sheet at a time;

second paper supply means for receiving the paper from the first paper supply means and conveying the paper to an image formation section;

the image formation section for forming an image by fixing a toner image after the toner image has been transferred to the paper supplied from the second paper supply means; and circulatory conveyance means for reversibly conveying and circulatorily conveying the paper, on which the image has been formed on a first surface thereof, to the second paper supply means once again, in order to form an image on a second surface of the paper, on which the image has been formed on the first surface thereof by the image formation section;

after an image has been sequentially formed on the first surfaces of a predetermined number of sheets of the paper by the image formation section, the sheets of paper being reversibly conveyed and circulatorily conveyed to the second paper supply means by the circulatory conveyance means, and then image being successively formed on the second surfaces of the paper, on which the image has been formed on the first surfaces thereof;

wherein a position at which the paper with the image formed on the first surface thereof, is accelerated from the paper conveyance speed during image formation in order for reversal and a position at which the post-reversal paper conveyance speed is decelerated in order to form the image on the second surface of the paper are alterable; and wherein images are formed on both sides of the paper without effecting control of the operation of the second paper supply means restricted by the number of image formed sheets per unit of time.

2. The image forming apparatus according to claim 1, wherein the position at which the paper is accelerated for reversal is determined by measuring the actual time from when conveyance of the paper from the second supply means to the image formation section is initiated to when the paper arrives at a position at which acceleration is possible.

3. The image forming apparatus according to claim 1, wherein the position at which the post-reversal paper conveyance speed is decelerated is determined by measuring the actual time from a position at which the post-reversal paper conveyance speed began to when the paper arrives at a position at which deceleration is possible.

4. An image forming apparatus having a paper waiting position where a sheet of paper to be supplied to an image formation section is caused to wait temporarily and a paper reversing means for reversing said paper with an image formed on one side thereof, said image forming apparatus comprising:

paper supply means for supply paper from said paper waiting position to said image formation section;

first paper conveying means for conveying the paper with the image formed on one side thereof from said image formation section to said paper reversing means;

second paper conveying means for conveying the paper reversed by said paper reversing means to said paper waiting position;

controlling means for controlling a paper conveying velocity so that said paper is accelerated at a predetermined timing during being conveyed by said first paper conveying means and the reversed paper is decelerated at another predetermined timing during being conveyed by said second paper conveying means; and correction means for correcting said timing of acceleration and deceleration of said paper.

5. The image forming apparatus according to claim 4 wherein said controlling means includes a first detecting means arranged along a paper conveyance path through which the paper is conveyed by said first paper conveying means for detecting completion of image formation on one side of said paper in said image formation section;

second detecting means arranged in the vicinity of said paper reversing means for detecting pass of the paper; and third detecting means arranged upstream of said paper waiting position along a paper conveyance path through which the reversed paper is conveyed by said second paper conveying means for detecting approach of the paper to said paper waiting position;

said correction means includes a calculation means for calculating said timing of acceleration and deceleration on the basis of said first, second and third detecting means.

* * * * *